United States Patent [19]

Nichols

[11] 4,174,750

[45] Nov. 20, 1979

[54] TUBE CLEANER HAVING ANCHORED ROTATABLE SPIRAL MEMBER

[76] Inventor: Billy M. Nichols, 21422 Park Rock La., Katy, Tex. 77450

[21] Appl. No.: 897,382

[22] Filed: Apr. 18, 1978

[51] Int. Cl.[2] ..... F28G 3/00; F28G 15/08

[52] U.S. Cl. ..... 165/94; 165/85; 165/95; 165/109; 165/174; 138/38; 138/108; 15/104.06 R

[58] Field of Search ..... 15/104.06 R, 104.09, 15/93 R; 165/94, 95, 85, 109, 174; 134/8, 22 C, 34; 366/280; 138/38, 37, 108

[56] References Cited

U.S. PATENT DOCUMENTS

| | | | |
|---|---|---|---|
| 304,470 | 9/1884 | Thomas | 15/104.06 R |
| 525,932 | 9/1894 | Whitney | 138/38 |
| 710,798 | 10/1902 | Nowotny | 15/104.06 R |
| 812,361 | 2/1906 | Pickles et al. | 15/104.06 R |
| 1,783,844 | 12/1930 | Jacobsen | 165/94 X |
| 2,310,234 | 2/1943 | Haug | 165/174 X |
| 2,943,845 | 7/1960 | Jaklitsch | 165/94 X |
| 3,086,372 | 4/1963 | Barger et al. | 165/109 X |
| 3,407,871 | 10/1968 | Penney | 165/109 X |

OTHER PUBLICATIONS

"Brush Cleaning of Condenser Tubes Saves Power, Costs", *Heating/Piping/Air Conditioning,* Sep. 1975, pp. 1–5.

*Primary Examiner*—Richard V. Fisher
*Attorney, Agent, or Firm*—Robert W. B. Dickerson

[57] ABSTRACT

A spirally configured member, rotatably positioned within an elongated tube, the spiral member adapted to continuously clean the tube's interior wall when such member is caused to rotate. The spiral has one end rotatably anchored by a plug fixed to one upstream end of the tube and a swivel linking the plug and the spiral member.

2 Claims, 3 Drawing Figures

TUBE CLEANER HAVING ANCHORED ROTATABLE SPIRAL MEMBER

BACKGROUND OF THE INVENTION

This invention has utility in industrial and/or scientific applications involving heat transfer or heat exchange. One typical use occurs in the operation of power plants. In such operations, large quantities of operating fluids, often at high temperatures, need be cooled, i.e., need have heat removed. A presently used mode of heat removal involves the circulating of transfer or working fluid through a large number of tubes. The operating fluids are caused to flow by the working-fluid tubes, permitting the exchange of heat between such fluids. Any event that reduces such heat exchange is deleterious to the process. While this example involves exchanging heat from an operating fluid to a cooling working fluid, it is unimportant to this invention the direction of heat exchange, i.e., from operating to working fluid, or vice versa. Of particular concern are [1] the forming of a contaminant layer on the inside tube wall, and [2] the forming of a thin annular, fluid film, sometimes described as a laminar film, of stagnant working fluid, just radially interior of the tube wall. Each of these disruptants apparently tends to reduce the exchange of heat between the adjacent fluids, i.e., acts as a heat insulator. Numerous approaches have been used to overcome these problems, such as the chemical and/or mechanical cleaning of the tube. Although a patent search has not been performed, applicant is aware of the "cleaning ball" system of Amertap Corporation, as described in its "An engineering staff report", and the brush cleaning system described in the September, 1975 issue of Heating/Piping/Air Conditioning published by Water Services of America, Inc. The former system utilizes sponge rubber balls, flowing in a closed circulation system, to clean the tube interior. The latter system includes cleaning brushes movable in a longitudinally extending tube. The direction of movement of the cleaning fluid may be reversed, so as to cause the brushes to periodically traverse the length of the tube. Applicant's system seeks to improve on the tube-cleaning systems described above.

SUMMARY OF THE INVENTION

A heat exchanger comprises a number of elongated tubes. For continuous cleansing purposes, each tube would include a spiral or auger member, rotatably mounted within such tube. Rotation would be effected by the motion of the working fluid passing through the tube. Cleansing would result from the contact or near contact of the edges of the spiral member with the interior tube wall.

DESCRIPTION OF A PREFERRED EMBODIMENT

Figure 1:
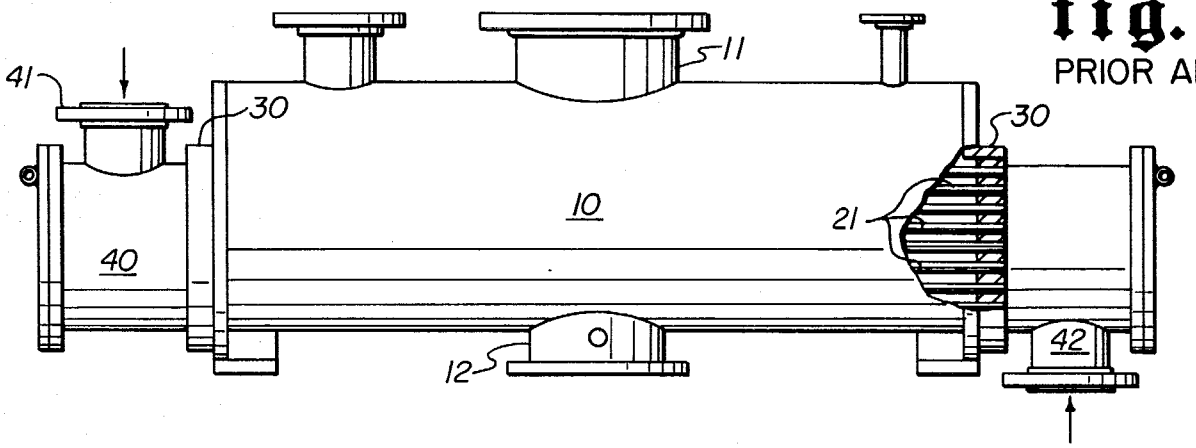
fig. 1 PRIOR ART
FIG. 1 is an elevation of a generalized heat transfer system, with a portion being broken away to illustrate the heat transfer tubes contained within the central housing.

Looking first at FIG. 1, a generalized system is illustrated for the transfer of heat between an operating and a working fluid. For ease of illustration, assume that the system is utilized in a power plant, which exudes a large quantity of high temperature fluid, such as water. Housing 10 is illustrated, which includes both inlet 11 and outlet 12 for such operating fluid. Axially extending through the housing is a plurality of open ended transfer tubes 21. The open ends of the tubes 22 are sealingly received within apertures 31 of spaced-apart tube sheets 30, so that operating fluid entering through inlet 11 will pass tubes 21 in heat exchanging manner without contaminating the working fluid.

Figure 2:
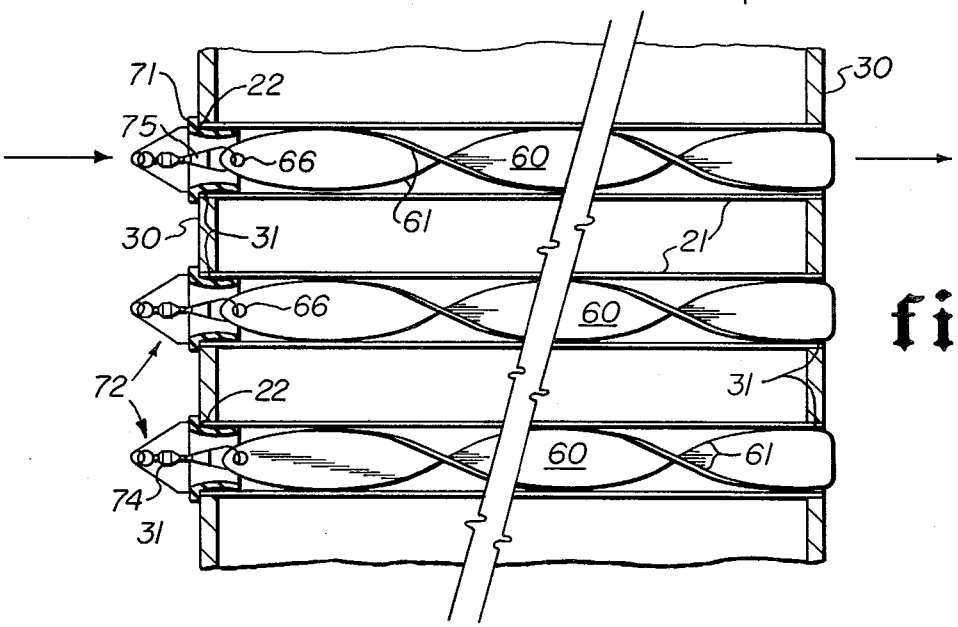
FIG. 2 is a broken vertical section through the tubes and tube sheets.

Working fluid may enter inlet 41 of water box 40, enter open ends 22 of tubes 21, pass through such tubes as illustrated by the arrows of FIG. 2, exit the other open end 22, and finally pass through exit 42, to perhaps be recirculated.

Figure 3:
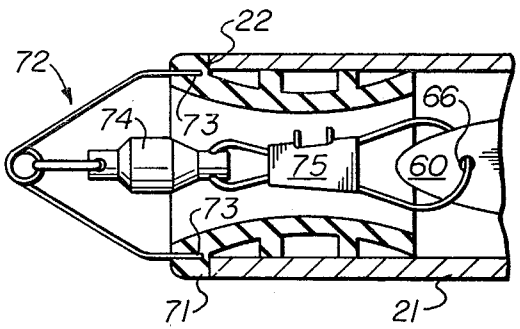
FIG. 3 is a detail of one form for rotatably connecting the cleansing spiral to a tube.

Look now specifically at FIGS. 2 and 3 for a more complete understanding of this invention, as distinguished from the overall operation of a heat exchanger, as previously discussed.

The actual length of tubes such as 21, may be substantial, sometimes forty feet or even longer. While the tube configuration may vary, such as being U-shaped, its ends 22 are open. Rotatably positioned within each tube is a spiral or auger member 60. Certain plastic materials appear to be sufficiently light and strong enough to perform satisfactorily, although other materials may also suffice. The radial dimensions of member 60 are such that in a relaxed position its opposite edges 61 may approximately contact interior walls of tube 21.

Means are provided to rotatably secure the spirals to the tubes 21 and to restrain axial movement of said spirals. In the embodiment shown, an annular, open ended venturi-shaped plug 71 is inserted within the upstream open ends 22 of tubes 21. A support 72, comprised of bent wire or similar material, has its ends 73 secured to plug 71. Said support 72 includes an eyelet or loop portion to which an ordinary swivel 74 is attached. Said swivel in each case then is linked to an aperture 66 in the tapered upstream end of spiral 60, by a releaseable keeper 75. This simple arrangement permits near free rotation of the spiral.

Consider now the operation of this tube cleaner, remembering all the while that the housing 10 of FIG. 1 may contain hundreds or even thousands of tubes 21. Assume that operating fluid is almost continuously moving from inlet 11, by tubes 21 in heat exchange relationship, and departing through outlet 12. The working fluid enters water box 40 through inlet 41, enters one open end 22 of all of tubes 21, courses through said tubes, causing spirals 60 to rotate, leaves tubes 21 through the other open end 22 thereof, and departs through exit 42. As spirals 60 rotate, they continuously remove contaminants from the inner walls of tubes 21, and also break up or disturb the laminar film annulus adjacent such inner walls.

Although only a single embodiment has been described, it should be obvious that numerous modifications would be possible by one skilled in the art without departing from the spirit of the invention, the scope of which is limited only by the following claims.

I claim:

1. A tube cleaning device for use in a heat exchanger comprising:

a plurality of tubes adapted to have a fluid pass therethrough; and rotatable means for preventing contaminant build-up on the interior wall provided each of said tubes, said rotatable means comprising a spiral having one end rotatably anchored by anchoring means to the upstream end of an associated tube, said anchoring means including a plug fixed to said upstream end and swivel means linking said plug and said rotatable means.

2. The device of claim 1 wherein said plug is of venturi configuration.

* * * * *